US005423094A

United States Patent [19]

Arsenault et al.

[11] Patent Number: 5,423,094

[45] Date of Patent: Jun. 13, 1995

[54] PNEUMATIC FURNITURE

[75] Inventors: Michael J. Arsenault, 1353 NE. 32nd Ave., Gainsville, Fla. 32609; Joseph Arsenault, Panama City, Fla.

[73] Assignee: Michael J. Arsenault, Gainesville, Fla.

[21] Appl. No.: 985,647

[22] Filed: Dec. 7, 1992

[51] Int. Cl.[6] ..... A47C 27/10

[52] U.S. Cl. ..... 5/455; 5/456; 5/449; 297/DIG. 3

[58] Field of Search ..... 5/449, 455, 456, 654; 297/DIG. 3

[56] References Cited

U.S. PATENT DOCUMENTS

| | | | |
|---|---|---|---|
| 1,371,919 | 3/1921 | Mahony | 5/455 X |
| 2,099,870 | 11/1937 | Stanley et al. | 5/455 X |
| 2,401,995 | 6/1946 | Weinzimmer | 5/455 X |
| 3,179,469 | 4/1965 | Heuston | 297/DIG. 3 |
| 3,605,145 | 9/1971 | Graebe | 5/456 |
| 3,864,767 | 2/1975 | Adams | 5/455 |
| 3,982,786 | 9/1976 | Burgin et al. | 5/455 |
| 4,405,129 | 9/1983 | Stuckey | 5/654 X |
| 4,445,240 | 5/1984 | Voorhees | 5/654 X |
| 4,459,714 | 7/1984 | Lin | 5/455 |
| 4,860,397 | 8/1989 | Gusakov | 5/654 X |
| 5,003,653 | 4/1991 | Mar | 5/455 X |
| 5,044,030 | 9/1991 | Balaton | 5/654 X |
| 5,228,156 | 7/1993 | Wang | 5/449 |

*Primary Examiner*—Michael F. Trettel

[57] ABSTRACT

A variety of pneumatic and other components assembled to afford comfort not found in conventional furniture as follows: a pneumatic cushion exchanging air through a bladder support into two independent bladders where upon depression by persons or other subsequence weight applied to the cushion evenly supports the weight applied. The inner and outer bladder operate independently receiving and compressing air through the cushion and bladder air transfer valves. This independent action allows frontal support when weight is applied to the frontal areas only. In addition to the frontal support a molded plastic material termed herein as the bladder support having memory after thermal molding offers additional front support when weight is applied. When weight or a person is fully seated both bladders are expanded as the air is expelled from the cushion through two air valves serving each of two independent bladders offering uniform seating support. The supporting structure for the bladder support, bladders, and cushion being a composite substrate with properties allowing a depression value allowing additional flex when weight is applied.

4 Claims, 2 Drawing Sheets

ISOMETRIC CUTAWAY VIEW

Cutaway & Interactive Views

Figure 1:
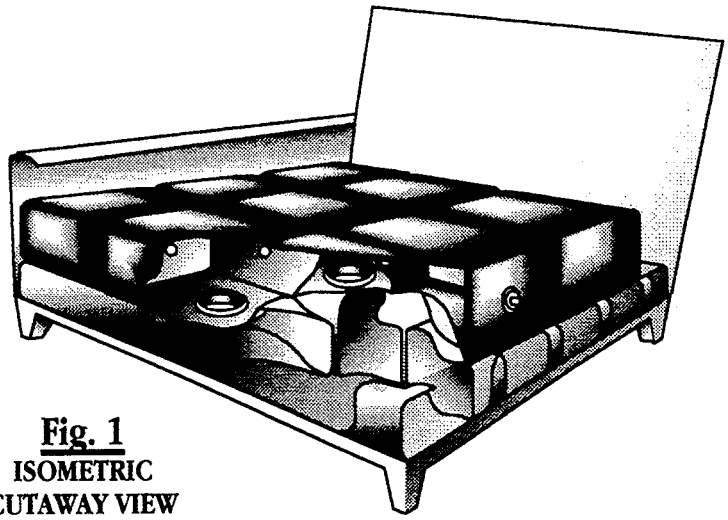

ISOMETRIC
CUTAWAY VIEW

ISOMETRIC EXPLODED
CUTAWAY VIEW

Cutaway & Interactive Views

PNEUMATIC FURNITURE

BACKGROUND

1. Field of Invention

This invention relates to the use of pneumatic, cushions combined with rubber, cushions ABS supporting plastics and a bladder system, to provide equal or superior comfort compared to conventional overstuffed furniture.

2. Description of Prior Art

Conventional cushions contained interdependent coil springs arranged on a base in a uniform pattern with padding across the top. Springs, however, resist the weight load with a force in proportion to the amount they are deflected. Therefore the springs deflected the most, bear against the body with the greatest force. Conventional air mattresses react similarly when subjected to a load. Persons spending a great deal of time sitting in chairs or lying in bed are prone to experience pressure sores. It is generally agreed that concentrated pressure areas caused by bony prominences result in reduced circulation in such body areas thus producing discomfort in the form of pressure sores.

While air cushions, water mattresses and gel pads have tried to address this problem, there has not been a solution which overwhelmingly meets the problem and commercially monopolizes the market.

No prior art was found relating to the function and application of pneumatic furniture utilizing air transfer from cushions to an enclosed bladder system. The closest known art consists of static pneumatic cushions which may or may not transfer air within itself.

OBJECTS AND ADVANTAGES

Accordingly several objects and advantages of our invention are:

(a) to provide support and minimize pressure on the stress points produced by the prominences on the body;

(b) to provide pneumatic furniture of the type set forth in the immediately preceding object and wherein the bladder and cushion support structure is made of a resin and glass composite, thereby making the entire piece of furniture light in weight;

(c) to provide pneumatic furniture of the type set forth in the immediately preceding objects and wherein the bladder support encasement is made of a compound or compounds having the properties of both memory and flexibility and after casting or molding provides firmness on the leading edge as well as being a restraint for the bladders;

(d) to provide pneumatic furniture of the type set forth in the immediately preceding objects and wherein the cushion contains air transfer valves allowing the pressure to equalize between the cavities and air transfer valves allow air or gas to communicate to the bladder(s);

(e) to provide pneumatic furniture of the type set forth in the immediately preceding objects and wherein the bladder system is encased in a bladder support structure, providing flexibility and preventing frontal edge collapse when weight is applied to cushion;

(f) to provide pneumatic furniture of the type set forth in the immediately preceding objects and wherein self annealing inner linings of the cushions prevent air loss from minor punctures.

Still further objects and advantages will become apparent from a consideration of the ensuing description and drawings.

DRAWING FIGURES

In the drawings,

FIG. 1 (isometric cutaway composite view) of our pneumatic cushion, the bladder & cushion supporting structure, the outer bladder, the inner bladder, and the substrate support.

Figure 2:
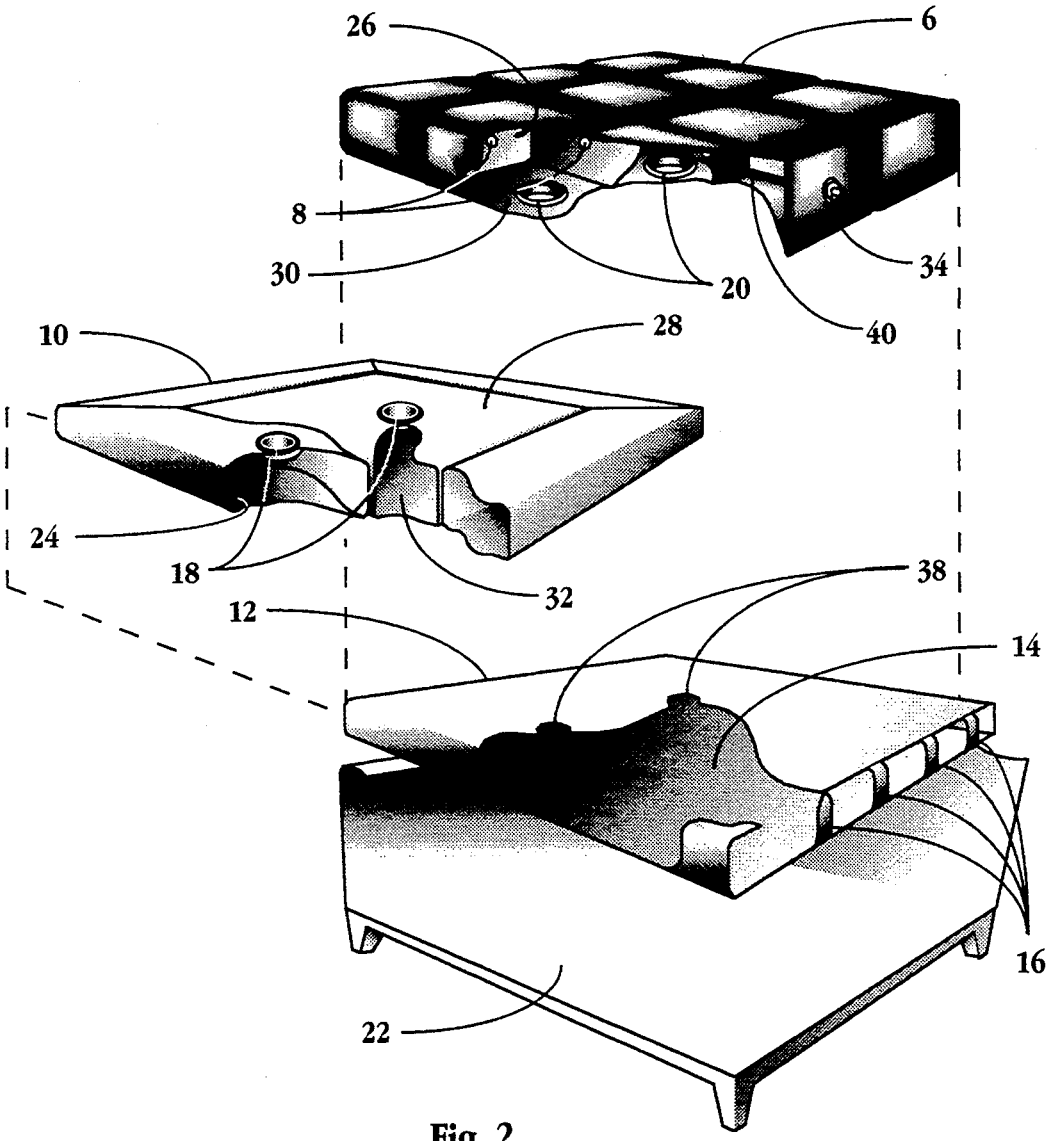

FIG. 2 (isometric exploded cutaway view) of the pneumatic furniture system.

Figure 3:
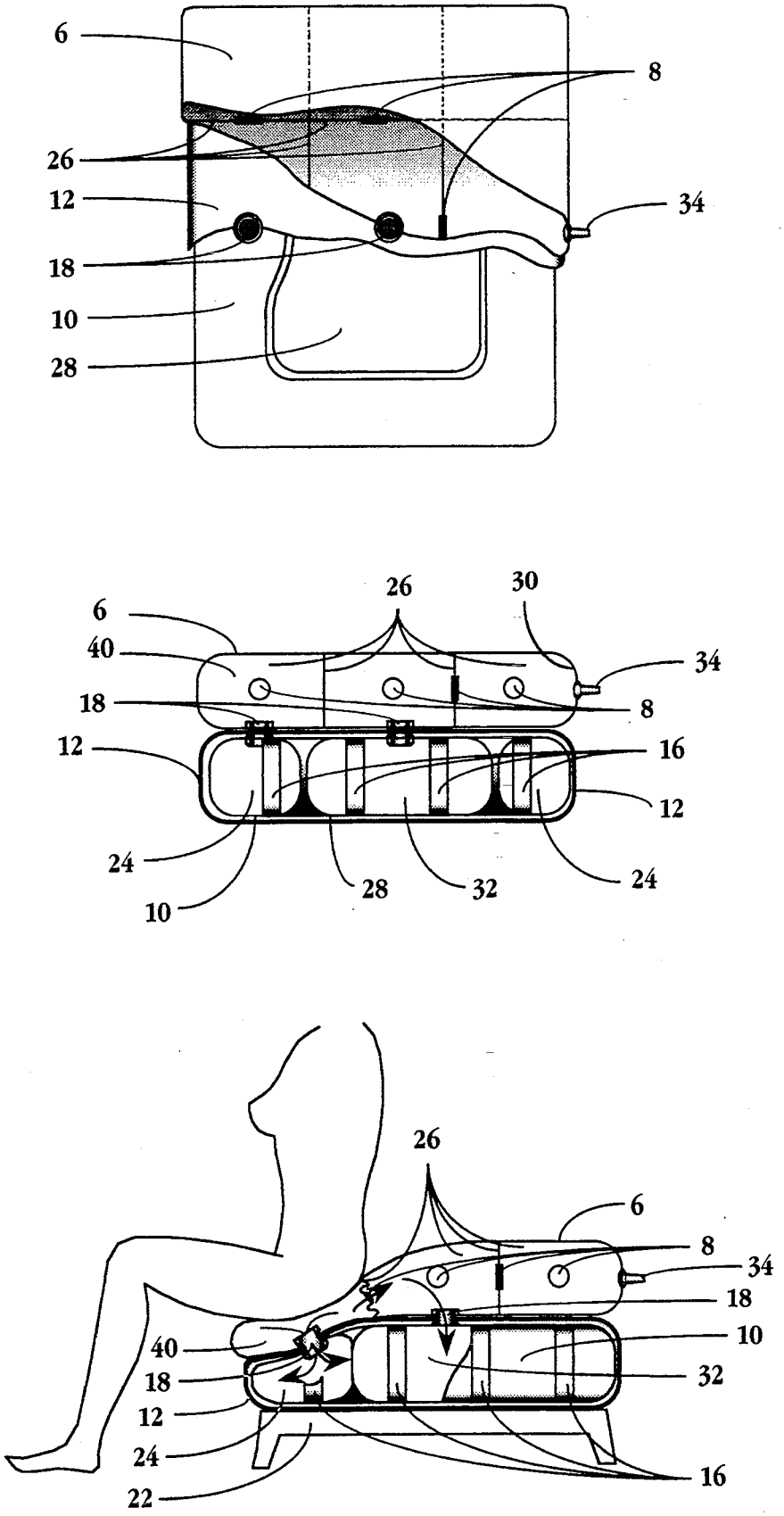

FIG. 3 a sectional view similar to FIG. 1, ilustrating a working condition of the present embodiment of the invention.

REFERENCE NUMERALS IN DRAWINGS

6 pneumatic cushion
10 outer bladder
14 bladder placement cavity
18 bladder air transfer valves
22 bladder & cushion supporting structure
26 cushion cavity dividers
30 self annealing puncture resistant coating
34 air fill valve
40 cushion air cavity
8 cushion divider air transfer valve
12 bladder support encasement
16 bladder side support straps
20 cushion air receiver transfer valves
24 outer bladder air cavity
28 inner bladder
32 inner bladder air cavity
38 cushion to badder air valve receiving holes

DESCRIPTION-FIGS. 1 TO 2

FIG. 1 shows a cutaway view of a typical embodiment of this invention. FIG. 2 is an exploded view of FIG. 1 showing pneumatic cushion 6, an air tight rubber like material with a self annealing, puncture resistant coating 30. The pneumatic cushion 6 has cushion cavity dividers 26, forming the cushion air cavity 40. Each cushion air cavity 40 is provided with cushion divider air transfer valves 8 to equalize air pressure between the cushion air cavity 40. The pneumatic cushion 6 contains cushion divider air transfer valves 8 and cushion air receiver transfer valves 20 which allow air transfer from the pneumatic cushion 6 to the outer bladder air cavity 24 and to the inner bladder cavity 32 through bladder air transfer valves 18. The cushion air transfer valves 20 interlock with the bladder air transfer valves 18 through cushion to bladder air transfer valve receiving holes 38.

The outer bladder 10 and the inner bladder 28 receive the transfer of air from the pneumatic cushion 6 through cushion air receiver transfer valves 20 and the bladder air transfer valves 18, when pressure is applied to the pneumatic cushion 6. The outer bladder 10 and the inner bladder 28 are partially deflated when in a static state. The outer bladder 10 and the inner bladder 28 expand fully to fill the cavity of the bladder support encasement 12 when pneumatic cushion 6 is activated by depression. The outer bladder 10 and the inner bladder 28 incorporate bladder air transfer valves 18 which interlock pneumatic cushion 6 for the purpose of transferring air to and from outer bladder 10 and inner bladder 28. The prior functions take place after inflating the pneumatic cushion 6 through the air fill valve 34.

The bladder support encasement 12 is to contain and encompass the outer bladder 10 and the inner bladder 28 located in the bladder placement cavity 14. More specifically, FIG. 3 shows bladder support encasement 12 is made of a compound or compounds having the properties of both memory and flexibility after casting or molding and which retains memory and flexibility and offers additional support on the leading edge when weight is applied. The bladder support encasement 12 allows air or gas to communicate to and from pneumatic cushion 6 through cushion to bladder air valve receiving holes 38 to the outer bladder 10 and the inner bladder 28 while offering a flexible buffer substrate being supported by communication of air pressure. The bladder support encasement 12 incorporates bladder side support straps 16 on opposing sides to allow expansion while constraining outer bladder 10 and inner bladder 28 to remain horizontally within the dimensions of the bladder support encasement 12. The bladder and cushion supporting structure 22 is produced from a resin and glass composite light in weight and to a degree flexible, adding additional depression capabilities when weight is applied in any form.

FIG. 2 shows the assembly wherein the bladder and cushion supporting structure 22 receives the bladder support encasement 12. The outer bladder 10 and the inner bladder 28 are inserted into the bladder placement cavity 14. The bladder air transfer valves 18 are inserted through the cushion to bladder air valve receiving holes 38. The pneumatic cushion 6 is placed over the bladder support encasement 12 and the bladder air transfer valves 18 are connected to the cushion air receiver transfer valves 20. The system is now integrated and upon pressurizing the system through the air fill valve 34, the application is ready for use.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

OPERATION-FIGS. 1,2,3

The operation of the pneumatic furniture can best be viewed in FIG. 3. A person is seated on the top front edge of the pneumatic cushion 6. As shown in the human form outline, pressure on the front cushion air cavity 40 increases beyond that experienced in adjacent center and rear cushion air cavities 40. The action caused by depressing either front, center or rear cushion air cavities 40, dispels air or gas through the outer bladder air cavity 24 and inner air bladder cavity 32. As increased weight is applied, for instance as illustrated in FIG. 3, on the frontal edge of pneumatic cushion 6, resistance to the increased applied weight is supplied by the bladder support encasement 12.

The bladder support encasement 12 is of a suitable compound so as to have the properties of retaining an after mold memory while also retaining a degree of flexibility. The bladder support encasement 12 encases outer bladder 10 and inner bladder 28 on four sides, top, bottom rear and front.

A person seated on the top front edge of pneumatic cushion 6, shown in FIG. 3, causes air or gas to discharge from front cushion air cavity 40 and to discharge through cushion divider air transfer valves 8, seeking equal pressure in center and rear cushion air cavities 40. The action of sitting on or applying weight to the front top edge of pneumatic cushion 6 equalizes pressures in cushion air cavities 40 and wiill simultaneously transfer air or gas to outer bladder air cavity 24 and inner bladder air cavity 32 through the bladder air transfer valves 18. The air or gas passes through the bladder air transfer valves 18 into outer bladder air cavity 24 and inner bladder air cavity 32 which transfer outward air pressure to the bladder support encasement 12.

The bladder support encasement 12 is cast or molded with properties of both memory and flexibility. When the air or gas transfers from cushion air cavity 40 through bladder air transfer valves 18 into and compresses the air or gas in outer bladder air cavity 24 and inner bladder air cavity 32, the air or gas is exerted outward on the bladder support encasement 12. The bladder support encasement 12 has the properties of both memory and flexibility and while combining the outward force of the compressed air or gas from the outer bladder air cavity 24 and the inner bladder air cavity 32, the bladder support encasement 12 will stabilize the person or weight applied to the top of pneumatic cushion 6.

It is intended that when internal pressure in inner bladder air cavity 32 and outer blader air cavity 24 is increased as a person or weight is applied to the top of pneumatic cushion 6, this increased air or gas pressure is contained on the four internal sides of the bladder support encasement 12. While the pressure is contained on the four inner sides of the bladder support encasement 12, the pressure on either of the longitudinal sides of the bladder support encasement 12 is contained by bladder side support straps 16. The bladder side support straps 16 are flexible but not expandable, allowing the bladder support encasement 12 to concave or compress the pressure when weight is applied to pneumatic cushion 6. The bladder side support straps 16 contain the outer bladder 10 when it is charged with air or gas by a person or weight being applied to pneumatic cushion 6. It is further intended that the bladder side support straps 16, when placed adjacent to a like or identical configuration, will abut adjacent bladder side support straps 16 offering static resistance of an adjacent bladder side support straps 16 in a like and directly adjacent FIG. 3.

SUMMARY, RAMIFICATIONS, AND SCOPE

Accordingly, the reader will see that our invention of pneumatic furniture offers more comfort, lighter weight, and a noncollapsible frontal edge, differing substantially from conventional furniture. Further the pneumatic furniture offers additional advantages it that:

- it provides support to minimize pressure on the prominences on the body;
- it provides an air transfer bladder system for added support and stability;
- it provides a base support for the bladder support encasement and pneumatic cushion, made of a resin and glass composite, making the entire piece of furniture light in weight;
- it provides a bladder support encasement for firmness on the leading edge and additionally a restraint for the bladders;
- it provides air transfer valves which allow equal pressure between air cavities;
- it has self annealing inner lining of the air cushion to prevent air loss from minor punctures.

Although the description above contains many specificities, these should not be construed as limiting the scope of the invention but as merely providing illustrations of some of the presently preferred embodiments of this invention. For instance the pneumatic furniture may be constructed in the configuration of a mattress for reclining. Thus the scope of the invention should be determined by the appended claims and their legal equivalents, rather than by the examples given.

We claim:

1. A pneumatic cushioning device attached to an expandable bladder which is encased in a support comprising a pneumatic cushion with cavity dividers including means to transfer air or gas between the dividers, said pneumatic cushion including means to transfer air or gas to a connecting outer bladder and inner bladder, said outer bladder and inner bladder consisting of two separate and independent bladder cavities, each said outer bladder and inner bladder includes a means to transfer air or gas to said pneumatic cushion, said outer bladder and inner bladder are encased on the top, bottom, front and rear surfaces with a bladder support, with strips of pliant material on two opposing sides, and constructed of a suitable compound so as to have the properties of retaining memory and flexibility.

2. The invention as set forth in claim 1 and wherein said pneumatic cushion is placed on the top of said bladder support and said pneumatic cushion and said inner bladder and said outer bladder are attached by a means to transfer air or gas between said pneumatic cushion and said inner bladder and said outer bladder when weight is applied to the said pneumatic cushion while also allowing the air or gas to return to said pneumatic cushion when the weight is removed.

3. A pneumatic cushioning device having a bladder system consisting of an outer bladder and an inner bladder, each being independent and expandable and contained in a bladder support comprising a pneumatic cushion with cavity dividers including means to transfer air or gas between the dividers, said pneumatic cushion including means to transfer air or gas to a connecting bladder system, said bladder system consisting of an outer bladder and an inner bladder, each being independent and expandable, said outer bladder and said inner bladder are each attached to said pneumatic cushion by means of an air or gas transfer valve, said bladder system is enclosed with a bladder support encasement on the top, bottom, front and rear surfaces, and has strips of pliant material on two opposing sides, said bladder system is constructed of a suitable compound so as to have memory and flexibility allowing compression to a point short of collapsing on the front and rear edges and will not allow expansion on the front and rear edges in it's static position.

4. The invention as set forth in claim 3 and wherein said outer bladder and said inner bladder are placed into said bladder support and said outer bladder and said inner bladder expand by means of weight being applied to said pneumatic cushion through the two said air transfer valves, thus expanding the said inner and outer bladders within the said bladder support and wherein the said bladder support restricts full compression of the weight applied to said pneumatic cushion as well as serving as a restraint for said bladders.

* * * * *